US006082450A

United States Patent [19]

Snider et al.

[11] Patent Number: 6,082,450

[45] Date of Patent: Jul. 4, 2000

[54] APPARATUS AND METHOD FOR STIMULATING A SUBTERRANEAN FORMATION

[75] Inventors: Philip M. Snider, Houston, Tex.; Joseph P. Haney, Coeur d'Alene, Id.; David S. Wesson, DeSoto, Tex.

[73] Assignee: Marathon Oil Company, Findlay, Ohio

[21] Appl. No.: 09/057,157

[22] Filed: Apr. 7, 1998

Related U.S. Application Data

[63] Continuation-in-part of application No. 08/711,188, Sep. 9, 1996, Pat. No. 5,775,426.

[51] Int. Cl.[7] ..... E21B 43/11; E21B 43/263

[52] U.S. Cl. ..... 166/55.2; 166/63; 175/4.5

[58] Field of Search ..... 166/55, 55.1, 55.2, 166/297, 63, 308; 175/4.5, 4.54, 4.58, 4.6

[56] References Cited

U.S. PATENT DOCUMENTS

| | | | |
|---|---|---|---|
| 3,029,732 | 4/1962 | Greene | 102/21.6 |
| 3,064,733 | 12/1962 | Bourne, Jr. | 166/55 |
| 3,366,188 | 1/1968 | Hicks | 166/297 |
| 3,376,375 | 4/1968 | Porter | 175/4.58 |
| 3,952,832 | 4/1976 | Elmore et al. | 181/116 |
| 4,039,030 | 8/1977 | Godfrey et al. | 166/299 |
| 4,148,375 | 4/1979 | Dowler et al. | 181/117 |
| 4,191,265 | 3/1980 | Bosse-Platiese | 175/4.6 |
| 4,253,523 | 3/1981 | Ibsen | 166/299 |
| 4,391,337 | 7/1983 | Ford et al. | 175/4.6 |
| 4,502,550 | 3/1985 | Ibsen | 166/297 |
| 4,541,486 | 9/1985 | Wetzel et al. | 166/297 |
| 4,598,775 | 7/1986 | Vann et al. | 175/4.6 |
| 4,633,951 | 1/1987 | Hill et al. | 166/63 |
| 4,683,943 | 8/1987 | Hill et al. | 166/63 |
| 4,711,302 | 12/1987 | Jennings, Jr. | 166/250 |
| 4,798,244 | 1/1989 | Trost . | |
| 4,823,875 | 4/1989 | Hill | 166/280 |
| 4,823,876 | 4/1989 | Mohaupt | 166/299 |
| 5,005,641 | 4/1991 | Mohaupt | 166/63 |
| 5,355,802 | 10/1994 | Petitjean | 102/313 |
| 5,421,418 | 6/1995 | Nelson et al. | 166/297 |
| 5,598,891 | 2/1997 | Snider et al. | 166/308 |

OTHER PUBLICATIONS

*Journal of Petroleum Technology*, "Technology Digest; High–Energy–Gas Well Stimulation," Feb. 1998, pp. 16 and 83.

Haney et al., "The Application of an Optimized Propellant Stimulation Technique in Heavy Oil Wells," SPE 37531, 1997, pp. 173–182.

*Primary Examiner*—Frank Tsay
*Attorney, Agent, or Firm*—Jack E. Ebel

[57] ABSTRACT

A method for stimulating a subterranean formation which is penetrated by a well bore having casing positioned therein so as to establish fluid communication between the formation and the well bore. Propellant is secured to the outer surface of a carrier having a plurality of apertures formed therein. Detonating cord is positioned within said carrier and when ignited causes the propellant to ignite initially at each aperture. In this manner, the propellant is caused to burn in controlled, uniform manner. Upon burning, the propellant generates gases which clean perforations previously formed through the casing into the formation and which extend fluid communication between the formation and the well bore.

47 Claims, 5 Drawing Sheets

APPARATUS AND METHOD FOR STIMULATING A SUBTERRANEAN FORMATION

CROSS-REFERENCE TO RELATED APPLICATIONS

This application is a continuation-in-part of U.S. patent application, Ser. No. 08/711,188, filed Sep. 9, 1996. Now. U.S. Pat. No. 5,775,426.

BACKGROUND OF THE INVENTION

1. Field of Invention

The present invention relates to an apparatus and method for stimulating a subterranean formation(s), and more particularly, to such an apparatus and method wherein a propellant is employed to stimulate the subterranean formation(s) and/or to enhance the effectiveness of perforations which provide communication between a well and the formation(s).

2. Description of Related Art

Individual lengths of relatively large diameter metal tubulars are secured together to form a casing string which is positioned within a subterranean well bore to increase the integrity of the well bore and provide a path for producing fluids to the surface. Conventionally, the casing is cemented to the well bore face and subsequently perforated by detonating shaped explosive charges. These perforations extend through the casing and cement a short distance into the formation. In certain instances, it is desirable to conduct such perforating operations with the pressure in the well being overbalanced with respect to the formation pressure. Under certain overbalanced conditions, the well pressure exceeds the pressure at which the formation will fracture, and therefor, hydraulic fracturing occurs in the vicinity of the perforations. As an example, the perforations may penetrate several inches into the formation, and the fracture network may extend several feet into the formation. Thus, an enlarged conduit can be created for fluid flow between the formation and the well, and well productivity may be significantly increased by deliberately inducing fractures at the perforations. Gas generating propellants have been utilized in lieu of hydraulic fracturing techniques as a more cost effective manner to create and propagate fractures in a subterranean formation. In accordance with conventional propellant stimulation techniques, a propellant is ignited to pressurize the perforated subterranean interval either simultaneous with or after the perforating step so as to propagate fractures therein. One propellant stimulation tool consists of a cast cylinder of solid rocket propellant having a central ignition system which consists of a detonator cord positioned within a hole formed in the center of the cylinder of propellant. The hole may be provided with a thin walled aluminum or cardboard tube to assist in insertion of the detonator cord. However, this propellant stimulation tool lacks sufficient mechanical strength to withstand the forces encountered when run into a small diameter well bore, in particular a well bore which is deviated, and/or when the well bore temperature exceeds about 275°F. In an attempt to increase tool integrity during use in larger diameter well bores, a relatively large, heavy carrier, e.g. 3½" outer diameter and ⅜' thick, is positioned around the cylinder of propellant. However, the weight of this tool, e.g. 200 lbs. for a 20 foot carrier, inhibits the use thereof, especially in deviated well bores. Thus, none of these prior art devices which utilized propellants in stimulation tools have provided completely satisfactory results in well bores of varying diameters or a repeatable and reliable propellant burn in a discrete or controlled pattern. In view of this, a need exists for a propellant stimulation tool which possesses sufficient structural integrity as manufactured to be employed in vertical or deviated well bores of varying diameters and which provides an internally discrete and controlled burn pattern upon ignition of the propellant.

Thus, it is an object of the present invention to provide an apparatus for stimulating a subterranean formation utilizing a propellant in which the apparatus has a high degree of structural integrity.

It is also object of the present invention to provide an apparatus for stimulating a subterranean formation utilizing a solid mass of propellant which results in relatively no debris upon ignition.

It is another object of the present invention to provide an apparatus for stimulating a subterranean formation in which the number and position of the ignition points for propellant which is utilized in the apparatus is controlled thereby achieving a substantially repeatable burn of the propellant.

It is a further object of the present invention to provide an apparatus for stimulating a subterranean formation which can be utilized at relatively high temperatures.

SUMMARY OF THE INVENTION

To achieve the foregoing and other objects, and in accordance with the purposes of the present invention, as embodied and broadly described herein, one characterization of the present invention comprises an apparatus for stimulating a subterranean formation. The apparatus comprises a first tube having at least one aperture therein at a position along the length thereof, propellant material positioned on the outside of the tube at least at the position of the aperture, a first means for igniting the propellant material which is positioned within the interior of the tube, and a second means for igniting the first means.

Another characterization of the present invention comprises an apparatus for stimulating a subterranean formation which comprises a body of propellant having an inner surface and an outer surface and means for igniting the body of propellant at a plurality of spaced apart locations along the inner surface.

Yet another characterization of the present invention comprises a method of stimulating a subterranean formation which is penetrated by a well bore in fluid communication with the formation. The method comprises positioning propellant within a subterranean well bore in proximity to a subterranean formation and igniting the propellant at a plurality of locations on an inner surface of the propellant. Burning the propellant generates gases which extend fluid communication between the formation and the well bore.

A further characterization of the present invention is a method of manufacturing a propellant apparatus for use in stimulating a subterranean formation which comprises providing discrete ignitions points along an inner surface of a body of propellant.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DESCRIPTION OF THE PREFERRED EMBODIMENTS

Figure 1:
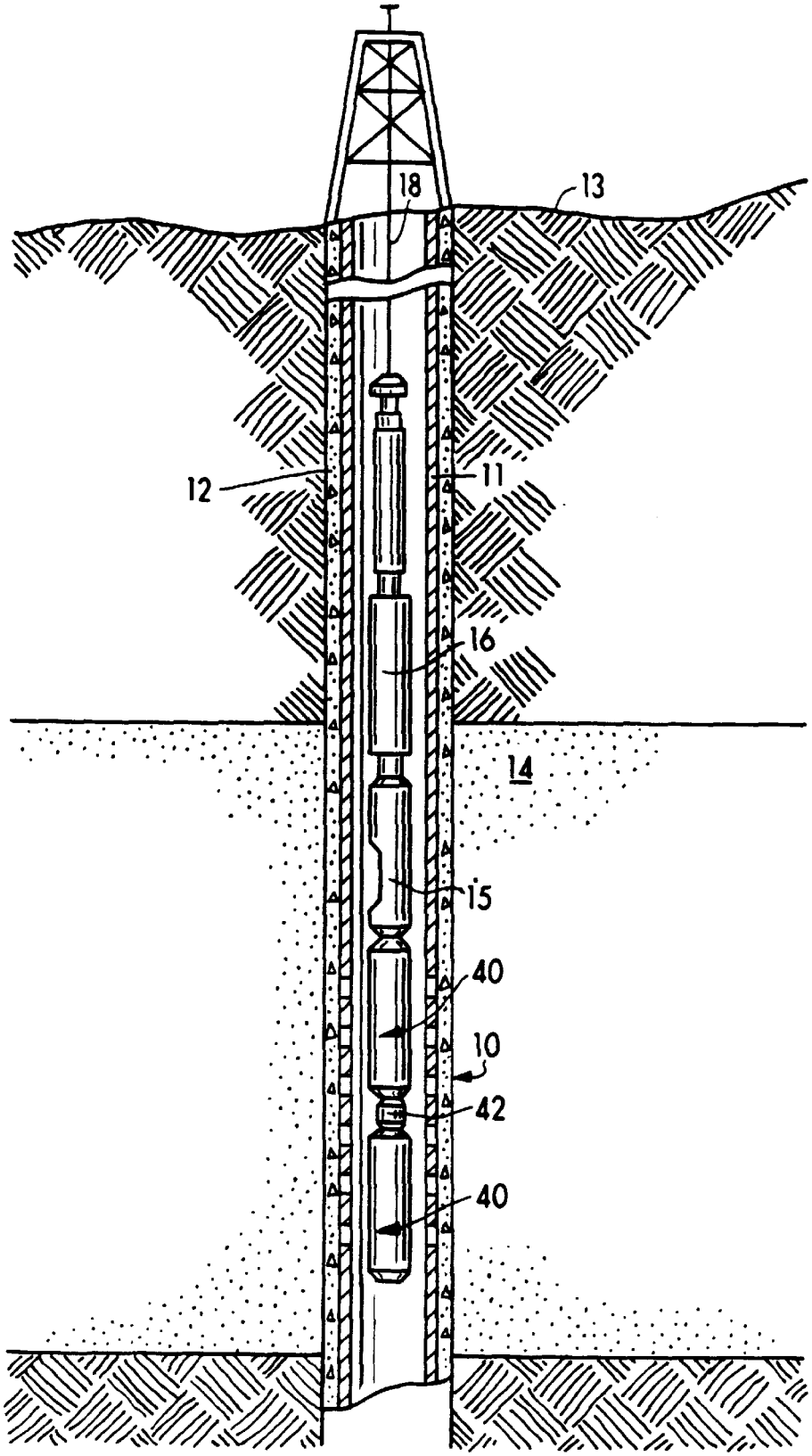
FIG. 1 is a cross sectional view of the apparatus of the present invention as positioned within a well penetrating a subterranean formation.

As illustrated in FIG. 1, a well 10 having a casing 11 which is secured therein by means of cement 12 extends from the surface of the earth 13 at least into a subterranean formation 14. One or more propellant apparatus 40 of the present invention are secured to the one end of an adapter sub 15 by any suitable means, such as screw threads. The other end of the adapter sub 15 is connected to one end of a logging tool 16, such as a collar log, by any suitable means, such as screw threads, while the other end of logging tool 16 is connected to a cable head 17 by any suitable means, such as screw threads. Cable head 17 is secured to a conventional wireline 18 and the propellant apparatus 40 are lowered into well 10. A coupling 42 (FIGS. 2C and 2D) may be utilized to secure apparatus 40 together. Any suitable means, such as a packer and tubing (not illustrated), may be employed to isolate the portion of well 10 adjacent interval 16, if desired. Alternatively, slick line, coil tubing, a tubing string or any other suitable means as will be evident to a skilled artisan may be used to position and support one or more apparatus 40 within a well bore.

Figure 2A:
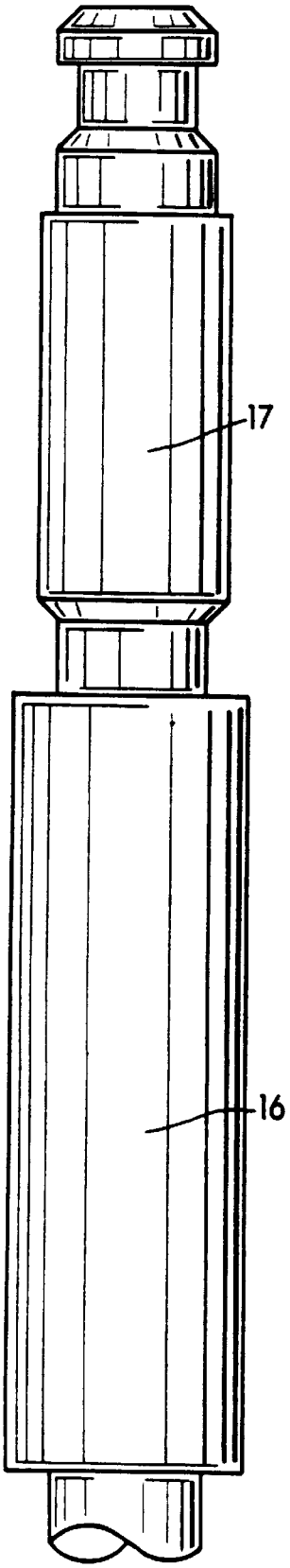
FIG. 2 is a partially cutaway, cross sectional view of the apparatus of one embodiment of the present invention.
Figure 2B:
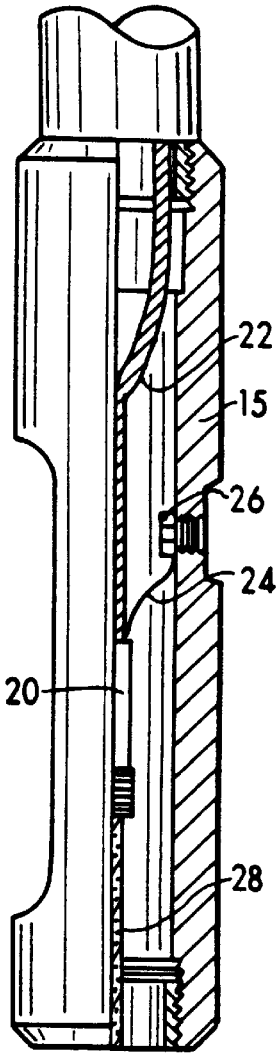
Figure 2C:
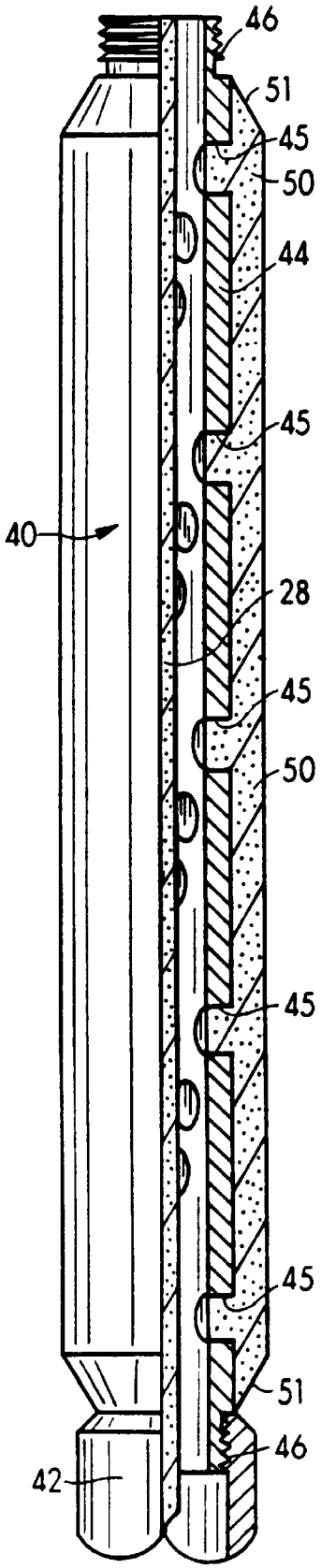
Figure 2D:
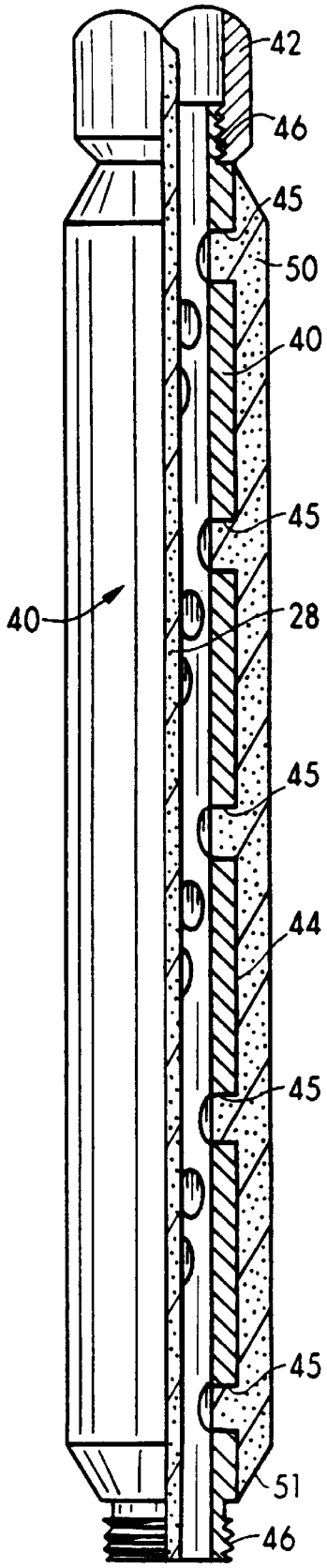

Referring to FIGS. 2A–D, two propellant apparatus 40 of the present invention are illustrated as secured together by means of a coupling 42. Each apparatus 40 comprises a carrier 44 having one or more apertures, ports or openings 45 therethrough. Where carrier 44 is provided with a plurality of aperture(s) 45, these apertures may be either uniformly or randomly spaced about the periphery of carrier 44 and may either extend along a portion of or along substantially the entire length of carrier 44. As utilized herein, the term "aperture" denotes a hole or port through the wall of carrier 44 or a relatively thin area in the wall of carrier 44 which ruptures upon detonation of an ignition means, such as a detonating cord. Although illustrated in FIGS. 2C and 2D as generally circular in cross section, aperture(s) 45 can be formed to have any other suitable cross sectional configuration, for example star shaped, cross shaped, etc., as will be evident to a skilled artisan. Carrier 44 is preferably formed of metal, such as a high grade steel. Each end of carrier 44 is provided with a suitable means of connection, such as screw threads 46. Carrier 44 may be bowed or constricted at one or more locations along the length thereof, although carrier 44 is preferably substantially straight as illustrated in FIGS. 2C and 2D.

Propellant 50 is secured to the outer surface 48 of carrier 44 by any suitable means, such as by molding the propellant thereon in a manner as described below. Propellant 50 may extend along the entire length of carrier 44 or a portion thereof, may extend about the entire circumference of carrier 44 or only a portion thereof, and preferably is positioned so as to cover at least a portion of at least one aperture 45. Although illustrated in FIGS. 2C and 2D as generally cylindrical in configuration, propellant may have other suitable configurations, for example spiral, one or more linear or curved strips, one or more generally annular rings, etc. Propellant 50 is constructed of a water repellant or water proof propellant material which is not physically effected by hydrostatic pressures commonly observed in a subterranean well bore during completion or production operations and is unreactive or inert to almost all fluids, in particular those fluids encountered in a subterranean well bore. Preferably, the propellant is a cured epoxy or plastic having an oxidizer incorporated therein such as that commercially available from HTH Technical Services, Inc. of Coeur d'Alene, Idaho and Owen Oil Tools, Inc. of Fort Worth, Tex. This propellant requires two independent conditions for ignition. The propellant must be subjected to a relatively high pressure, such as at least about 500 psi, and an ignition means must be fired.

Preferably, epoxy or plastic propellant which has an oxidizer incorporated therein is poured or injected into a mold (not illustrated) which is positioned around carrier 44 at a suitable location at the surface 14 in a manner as will be evident to a skilled artisan. A suitable mold may be positioned within carrier 44 and sized to permit propellant from extending into aperture(s) 45. In this manner, propellant 50 extends into aperture(s) 45 but terminates substantially at the inner diameter of carrier 44 as illustrated in FIGS. 2C and 2D. Propellant 50 is allowed to cure at ambient or elevated temperature so as solidify. As also illustrated in FIG. 2, propellant 50 is preferably provided with tapered ends 51 and is formed so as not to cover any portion of screw threads 46 of carrier 44. And although carrier 44 preferably has a substantially round cross sectional configuration, carrier 44 may also have any other cross sectional configuration, for example square, oval etc., that may be desired for a given subterranean well bore and/or application as will be evident to a skilled artisan.

An electrical cable 22 is connected at one end thereof to cable head 17 and at the other end thereof to a starter means, for example electrical detonator 20, which is positioned within adapter sub 15. Detonator 20 is grounded to sub 15 by means of ground wire 24 which is attached to sub 15 by any suitable means, such as screw 26. An ignition means, for example detonator cord 28 which is comprised of an explosive, is secured to detonator 20 and extends into apparatus 40. Detonator cord 28 preferably extends through the entire length of each apparatus 40. Although detonator cord 28 may be attached to the internal circumference of each carrier 44 by any suitable means, such as by metal clips, detonator cord 28 is preferably suspended only from detonator 20 and is allowed to be unsecured to carrier 44 as positioned and suspended therein. As constructed and assembled together, screw threads 46 on one end of a carrier 44 are mated with corresponding screw threads on adapter sub 15. Adapter sub 15 is connected to logging tool 16 and cable head 17 as described above. Cable head 17 is secured to a conventional wireline 18 and the propellant apparatus are lowered into well 10 adjacent interval 15 or other zone of interest. Carrier(s) 44 provide sufficient rigidity and internal structural integrity to apparatus 40 to ensure effective placement of the apparatus within a subterranean well bore, especially small diameter, deviated, and/or high temperature well bores, while inhibiting damage. Once positioned, current is passed from a suitable source at the surface via wireline 18 and electrical cable 22 to ignite detonator 20 which in turn ignites detonating cord 28. The temperature and pressure resulting from the ignition of the detonating cord ignites the propellant 50 at discrete locations in a predetermined pattern where propellant 50 extends into aperture(s) 45. The propellant 50 in aperture(s) 45 is confined and as such is easily ignited and develops a very rapid burn rate. The ignition of the propellant in aperture(s) 45 generates sufficient heat and pressure to ignite the remaining propellant 50 which is positioned outside of carrier 44. Pressurized gas generated from the burning of propellant 50 enters formation 14 through perforations formed in casing 11 thereby cleaning such perforations of debris. These propellant gases also stimulate formation 16 by extending the connectivity of formation 14 with well 10 by means of the pressure of the propellant gases fracturing the formation. Carrier 44 is usually not damaged to any significant extent, and as such, may be removed from the well via wireline 18 and be refurbished, if necessary, and reused.

Figure 3:
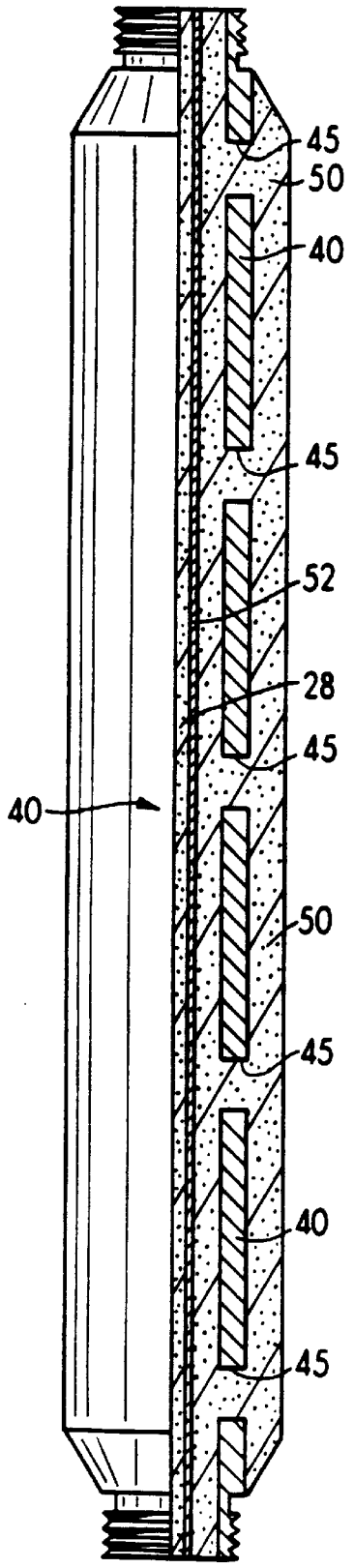
FIG. 3 is a partially cutaway, cross sectional view of another embodiment of the apparatus of the present invention.

Referring now to FIG. 3, another embodiment of the propellant apparatus of the present invention is illustrated generally as 40 and comprises an internal carrier 44 having propellant molded thereon. In this embodiment, a relatively small diameter inner tube 52 is positioned within carrier 44 and is preferably concentric therewith. Propellant 50 is poured into a mold surrounding carrier 40 and is allowed to fill the interior of carrier through aperture(s) 45 such that when cured propellant 50 forms a solid mass which extends from inner tube 52 through aperture(s) 45 to the exterior of carrier 44. In this embodiment, detonator cord 28 is positioned within inner tube 52 which disintegrates from the heat and pressure generated by the apparatus of the present invention.

Figure 4:
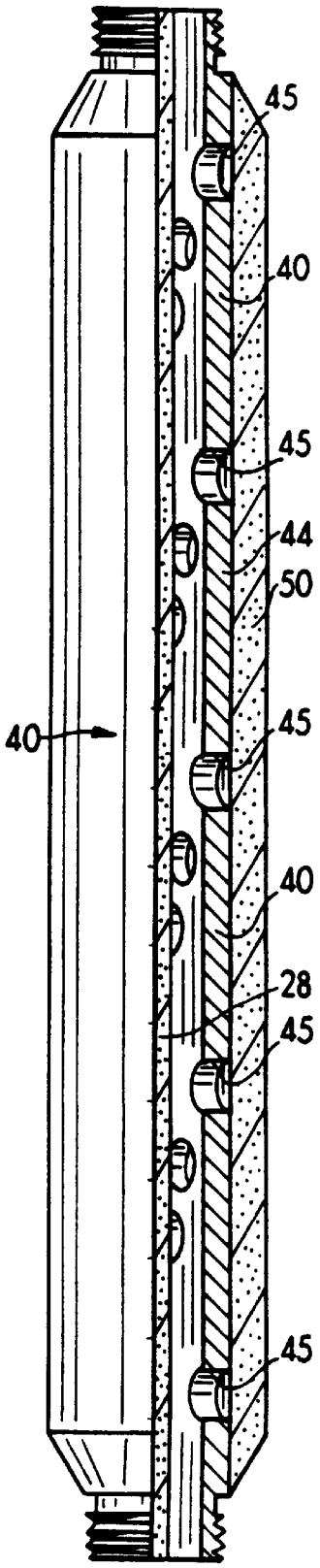
FIG. 4 is a partially cutaway, cross sectional view of still another embodiment of the apparatus of the present invention.

In the embodiment of the present invention which is illustrated in FIG. 4, a sleeve of suitable material, for example cardboard, is positioned around carrier 44 prior to propellant 50 being molded thereon in a manner as described above. As thus constructed, propellant 50 does not extend into aperture(s) 45 any significant distance. Alternatively, a sleeve of propellant 50 may be separately molded or formed and appropriately sized so as to be subsequently positioned around carrier 44 and held in place by any suitable means as will be evident to a skilled artisan. In the embodiment which is illustrated in FIG. 4, detonator cord 28 is positioned within carrier 44 and may or may not be secure to the inner diameter thereof.

Although carrier 44 and adapter sub 15 are preferably constructed of metal, carrier 44 and adapter sub 15 may be constructed of a material which substantially entirely breaks up or decomposes, for example a polyester fiber, epoxy composite, upon detonation of detonator 20.

Figure 5:
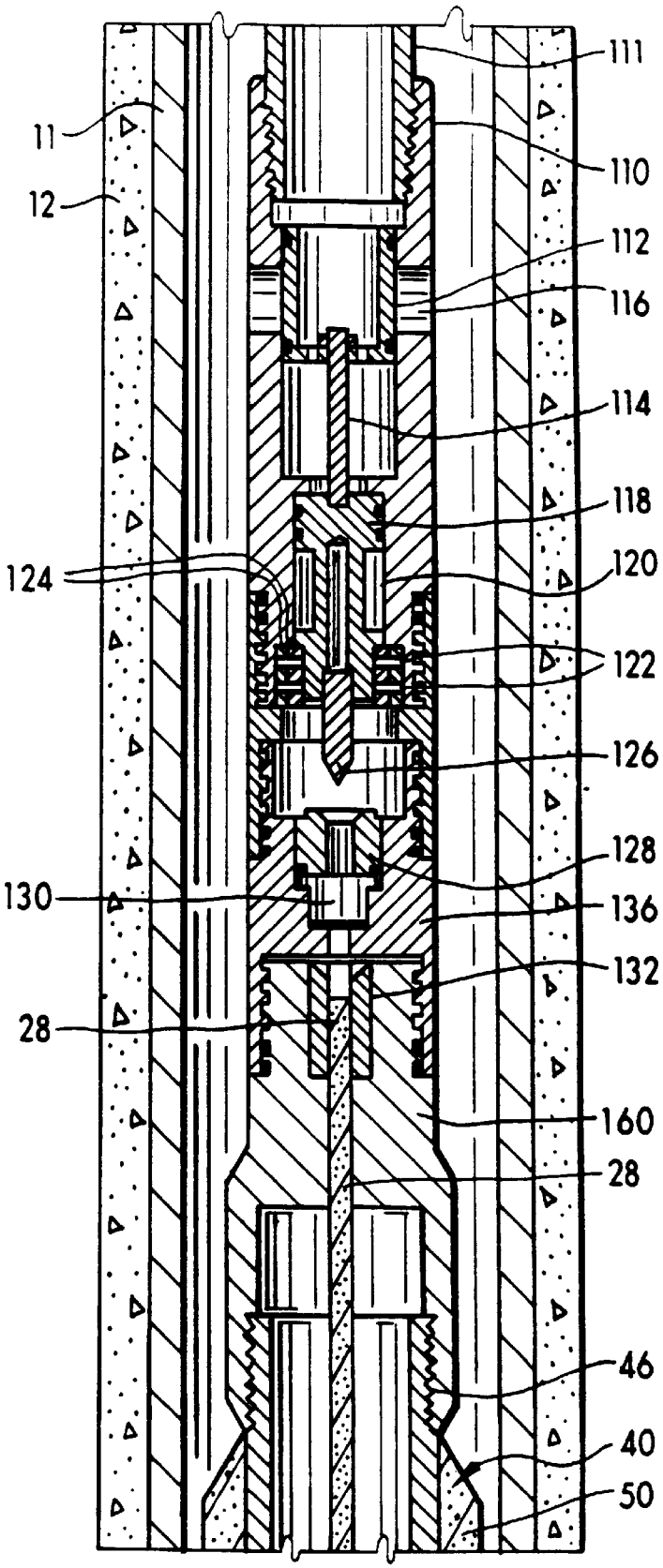
FIG. 5 is a cross sectional view of a percussion detonating system suitable for use in the present invention.

As described above and shown in FIG. 2B, an electrical detonator provides detonation of cord 28, and in turn propellant 50, where the stimulation apparatus of the present invention is run into a subterranean well on a wireline, slickline, etc. Alternatively, a percussion detonator may be employed, and is preferred for use in conjunction with the apparatus of the present invention where the apparatus is run into a subterranean well on a tubular, for example a conventional tubing string or coil tubing. As illustrated in FIG. 5, vent housing 110 is capable of attachment to the end of a tubing string 111 or wireline (not shown). A vent 112 is attached to connecting rod 114 inside vent housing 110 and seals fluid passage 116. Rod 114 is in contact with a piston 118. An annular chamber 120 between piston 118 and the interior wall of housing 110 is filled with air at atmospheric pressure. Adjacent the bottom of piston 118, shear pins 122 are mounted in shear set 124, and a firing pin 126 extends downward from the bottom of piston 118. Retainer 128 joins vent housing 100 and tandem sub 60. Percussion detonator 130 is mounted in retainer 128 in firing head 136 which is attached to vent housing 110 and capable of attachment to tandem sub 60. Sub 60 is attached to propellant apparatus 40. An ignition transfer 132 at the top of sub 60 is in contact with detonating cord 28 passing through central channel 134 and propellant apparatus 40, as described above. A booster transfer is located in each tandem sub 60, linking the detonating cords in the propellant apparatus 40 above and below the tandem sub.

Upon application of sufficient hydraulic pressure to the top of piston 118, vent 112 and piston 118 simultaneously move downward, opening fluid passage 114 and causing firing pin 126 to contact percussion detonator 130. The ignition of percussion detonator 130 causes a secondary detonation in ignition transfer 132, which in turn ignites detonating cord 28. Detonating cord 28 comprises an explosive and runs between the ends of each propellant apparatus. Cord 28 ignites the propellant 50 in apparatus 40 and booster transfer, which contains a higher grade explosive than detonating cord 28.

The following example demonstrates the practice and utility of the present invention, but is not to be construed as limiting the scope thereof.

EXAMPLE

A 36 inch long, 1 inch outer diameter, 0.5 inch inner thick steel tube is provided with a plurality of uniformly spaced holes about the periphery and along the entire length thereof. The steel tube is threaded at both ends thereof and an epoxy propellant having an oxidizer incorporated therein is molded around the steel tube and cured so as to form a 2 inch outer diameter propellant stimulation tool. A 40 grain detonating cord is run throughout the entire length thereof and is secured to a blasting cap in an adapter sub. The tool and sub are threaded together and the sub is in turn threaded to a logging tool string and a cable head. A wire line is secured to the cable head and the entire assembly is lowered into a subterranean well and is positioned by means of wireline to stimulate a 4 foot subterranean interval at about 10,000 feet. A fast pressure gauge is also run. Electrical current is provided to the wireline from a generator at the surface and the blasting cap. The detonating cord is detonated which in turn ignites the propellant.

The propellant apparatus of the present invention can be utilized with tubing or wireline. The increased strength of the tubing over wireline allows the use of a longer propellant apparatus and/or more apparatus to be secured together, thereby permitting a longer interval to be stimulated in a single trip into a well. A tubing-conveyed apparatus is also compatible with the use of packers to isolate one or more portions of the well adjacent one or more intervals of the formation. Thus, the method may be used where it is desired for some other reason to limit the pressure to which another portion of the well is subjected, for example, in a well where one or more other zones have already been completed. Further, if the well has a high deviation angle from vertical or is horizontal, the tubing may be used to push the perforating and propellant apparatus into the well.

As discussed above, the ignition means may be a detonating material, such as detonating cord 28. Alternatively, the ignition means may be a deflagrating material or cord. For example, a tube containing black powder may be utilized as the ignition system to ignite the propellant in the apparatus and method of the present invention.

While the foregoing preferred embodiments of the invention have been described and shown, it is understood that the alternatives and modifications, such as those suggested and others, may be made thereto and fall within the scope of the invention.

We claim:

1. An apparatus for stimulating a subterranean formation comprising:

a first tube having at least one aperture therein at a position along the length thereof;

propellant material positioned on the outside of said tube at least at said position;

first means for igniting said propellant material, said first means being positioned within the interior of said first tube; and second means for igniting said first means.

2. The apparatus of claim 1 wherein said aperture extends through said first tube.

3. The apparatus of claim 1 wherein said aperture has a substantially round configuration.

4. The apparatus of claim 1 wherein said first tube is substantially cylindrical in configuration.

5. The apparatus of claim 1 wherein said propellant material does not extend into said at least one aperture.

6. The apparatus of claim 2 wherein said propellant material extends into said at least one aperture.

7. The apparatus of claim 5 wherein said propellant material extends substantially to the inner diameter of said first tube.

8. The apparatus of claim 2 wherein said propellant material extends into to interior of said first tube.

9. The apparatus of claim 1 wherein said propellant material is a cured epoxy or plastic having an oxidizer incorporated therein.

10. The apparatus of claim 1 wherein said first tube is formed of a material which does not decompose or disintegrate upon detonation of said propellant material.

11. The apparatus of claim 1 further comprising:

a second tube positioned within said first tube and having said first means positioned therein.

12. The apparatus of claim 11 wherein said propellant material extends through said at least one aperture so as to be juxtaposed with said second tube.

13. The apparatus of claim 12 wherein said propellant material is juxtaposed with said second tube along substantially the entire length thereof.

14. The apparatus of claim 11 wherein said propellant extends through said at least one aperture so as to be contiguous with said second tube.

15. The apparatus of claim 14 wherein said propellant material is contiguous with said second tube along substantially the entire length thereof.

16. The apparatus of claim 1 wherein said propellant is water repellant or water proof, is not physically effected by hydrostatic pressures encountered in a subterranean formation and is unreactive or inert to fluids which may be encountered in a well penetrating and in fluid communication with said subterranean formation.

17. The apparatus of claim 16 wherein said propellant is a cured epoxy or plastic having an oxidizer incorporated therein.

18. The apparatus of claim 1 wherein said first tube has a plurality of said apertures therethrough.

19. The apparatus of claim 18 wherein said plurality of apertures extend substantially the entire length of said first tube.

20. The apparatus of claim 18 wherein said plurality of apertures extend about substantially the entire periphery of said first tube.

21. The apparatus of claim 18 wherein said plurality of apertures are arranged in a uniform pattern about said first tube.

22. The apparatus of claim 1 wherein said first means is a detonating material.

23. The apparatus of claim 22 wherein said detonating material is a detonating cord.

24. The apparatus of claim 1 wherein said first means is a deflagration material.

25. The apparatus of claim 24 wherein said first means is a tubular member containing black powder.

26. The apparatus of claim 1 wherein said second means is a detonator.

27. An apparatus for stimulating a subterranean formation comprising:

a body of propellant having an inner surface and an outer surface; and means for igniting said body of propellant at a plurality of spaced apart locations along said inner surface, said means comprising a first tube having at least one aperture therein at a position along the length thereof, said body of propellant being secured to the outside of said tube at least at said position, detonator cord positioned within the interior of said tube, and a detonator.

28. The apparatus of claim 27 wherein said body of propellant extends into said at least one aperture.

29. The apparatus of claim 27 wherein said body of propellant extends into to interior of said first tube.

30. The apparatus of claim 27 wherein said plurality of spaced apart locations extend substantially the entire length of said first tube.

31. The apparatus of claim 27 wherein said plurality of spaced apart locations extend about substantially the entire periphery of said first tube.

32. The apparatus of claim 27 wherein said plurality of spaced apart locations are arranged in a uniform pattern.

33. The apparatus of claim 27 wherein said aperture extends through said first tube.

34. The apparatus of claim 27 wherein said detonator is connected to said detonator cord.

35. An apparatus for stimulating a subterranean formation comprising:

a body of propellant having an inner surface and an outer surface, wherein said propellant is a cured epoxy or plastic having an oxidizer incorporated therein; and means for igniting said body of propellant at a plurality of spaced apart locations along said inner surface.

36. An apparatus for use in a subterranean well comprising:

a carrier having at least one discrete ignition site along the length thereof;

propellant material secured to said carrier; and a detonating source positioned within said carrier.

37. The apparatus of claim 36 wherein said carrier has at least one aperture and each of said at least one discrete ignition sites is defined at a junction of said propellant material and one of said at least one aperture.

38. The apparatus of claim 37 wherein said at least one aperture extends through said carrier.

39. The apparatus of claim 38 wherein said propellant material does not extend into said at least one aperture.

40. The apparatus of claim 38 wherein said propellant material extends into said at least one aperture.

41. The apparatus of claim 37 wherein said at least one aperture has a substantially round configuration.

42. The apparatus of claim 37 wherein said carrier has a plurality of said apertures.

43. The apparatus of claim 42 wherein said plurality of apertures extend substantially the entire length of said carrier.

44. The apparatus of claim 42 wherein said plurality of apertures extend about substantially the entire periphery of said carrier.

45. The apparatus of claim 42 wherein said plurality of apertures are arranged in a uniform pattern about said carrier.

46. The apparatus of claim 36 wherein said carrier has a substantially circular cross section.

47. The apparatus of claim 36 wherein said carrier is formed of a material which does not decompose or disintegrate upon detonation of said propellant material.

* * * * *

UNITED STATES PATENT AND TRADEMARK OFFICE

CERTIFICATE OF CORRECTION

PATENT NO. : 6,082,450
DATED : July 4, 2000
INVENTOR(S) : Philip M. Snider, et al.

It is certified that error appears in the above-identified patent and that said Letters Patent is hereby corrected as shown below:

Col. 7, line 7 : Following "said" insert –first--.
Col. 7, line 16 : Following "said" insert –first--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*